US010308454B2

(12) United States Patent
Okumura

(10) Patent No.: US 10,308,454 B2
(45) Date of Patent: Jun. 4, 2019

(54) SHEET CONVEYING APPARATUS

(71) Applicant: BROTHER KOGYO KABUSHIKI KAISHA, Nagoya-shi, Aichi-ken (JP)

(72) Inventor: Masayuki Okumura, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/870,039

(22) Filed: Jan. 12, 2018

(65) Prior Publication Data

US 2018/0201456 A1 Jul. 19, 2018

(30) Foreign Application Priority Data

Jan. 17, 2017 (JP) ..... 2017-005569

(51) Int. Cl.

| | |
|---|---|
| ***B65H 3/06*** | (2006.01) |
| ***B65H 1/04*** | (2006.01) |
| ***B65H 1/24*** | (2006.01) |
| ***B65H 1/14*** | (2006.01) |

(52) U.S. Cl.

CPC ..... *B65H 3/0684* (2013.01); *B65H 1/04* (2013.01); *B65H 1/14* (2013.01); *B65H 1/24* (2013.01); *B65H 2405/1116* (2013.01); *B65H 2405/11151* (2013.01); *B65H 2405/11162* (2013.01); *B65H 2801/03* (2013.01)

(58) Field of Classification Search

CPC ..... B65H 1/04; B65H 1/14; B65H 3/0684; B65H 2405/1111; B65H 2405/1117

USPC ..... 271/117, 126, 127, 147

See application file for complete search history.

(56) References Cited

U.S. PATENT DOCUMENTS

| | | | | |
|---|---|---|---|---|
| 5,255,903 | A * | 10/1993 | Parsons | B65H 3/0638 271/10.12 |
| 7,188,835 | B2 * | 3/2007 | Lee | B65H 1/12 271/147 |
| 7,448,611 | B2 * | 11/2008 | Chang | B65H 3/0669 271/114 |
| 2002/0079639 | A1 * | 6/2002 | Hsieh | B65H 1/08 271/147 |

(Continued)

FOREIGN PATENT DOCUMENTS

| | | |
|---|---|---|
| JP | 7-232832 A | 9/1995 |
| JP | 10-129864 A | 5/1998 |
| JP | 2000-233836 A | 8/2000 |

(Continued)

*Primary Examiner* — David H Bollinger

(74) *Attorney, Agent, or Firm* — Merchant & Gould, P.C.

(57) ABSTRACT

A sheet conveying apparatus, including: a sheet container; a roller; an arm rotatably supporting the roller; and a presser plate for pressing sheets in the container, wherein distal and basal portions of the presser plate define a bend angle when bent, the bend angle being an angle defined on one side of the presser plate farther from the arm, the bend angle being maintained at an obtuse angel in a first-amount loaded state of the container, and wherein a contact angle of the arm and the sheets at a contact position thereof is smaller than a maximum angle from a maximally loaded state to the first-amount loaded state, the maximum angle being an angle defined by: the basal portion in the maximally loaded state; and the arm whose roller contacts the presser plate in the maximally loaded state when assumed that the sheets are not loaded on the presser plate.

13 Claims, 10 Drawing Sheets

(56) References Cited

U.S. PATENT DOCUMENTS

2009/0108516 A1* 4/2009 Shigeno ..... B65H 3/0684
271/126

FOREIGN PATENT DOCUMENTS

| | | | |
|---|---|---|---|
| JP | 2001-106345 | A | 4/2001 |
| JP | 2002-87619 | A | 3/2002 |
| JP | 2003-12171 | A | 1/2003 |

* cited by examiner

SHEET CONVEYING APPARATUS

CROSS REFERENCE TO RELATED APPLICATION

The present application claims priority from Japanese Patent Application No. 2017-005569, which was filed on Jan. 17, 2017, the disclosure of which is herein incorporated by reference in its entirety.

BACKGROUND

Technical Field

The following disclosure relates to a sheet conveying apparatus configured to covey sheets such as paper.

Description of Related Art

There is known an apparatus configured to convey sheets and having a first supply roller (roller) supported at a distal end of a pivotable arm. The roller is rotated while being held in contact with a front surface of an uppermost one of the sheets stored in a supply tray, so that the uppermost sheet is conveyed.

SUMMARY

In the known apparatus, an angle defined by the arm and the sheets in the supply tray on an upstream side of the sheets in a sheet conveyance direction, namely, a contact angle, changes in a time period from a fully loaded state of the supply tray in which a maximal amount of the sheets are loaded on the supply tray to a near empty state of the supply tray in which a minimal amount of the sheets are loaded on the supply tray. Specifically, the contact angle increases with a decrease in the amount of the sheets loaded on the supply tray. As a result, a pressing force applied by the roller to the sheets becomes large, so that a plurality of sheets are likely to be conveyed in an overlapping state, namely, multiple feeding of the sheets tends to occur.

Accordingly, one aspect of the disclosure relates to a sheet conveying apparatus capable of preventing or reducing an occurrence of multiple feeding of sheets in a time period from the fully loaded state to the near empty state.

In one aspect of the disclosure, a sheet conveying apparatus including: a container for storing a stack of a plurality of sheets; a roller rotatable about a rotation shaft parallel to the plurality of sheets stored in the container and configured to convey the plurality of sheets one by one in a conveyance direction by rotating about the rotation shaft while being held in contact with a front surface of the plurality of sheets stored in the container, an arm including a supporter that rotatably supports the roller, the arm being pivotable about an arm pivot shaft parallel to the rotation shaft while the supporter is located downstream of the arm pivot shaft in the conveyance direction, and a presser plate configured to press the plurality of sheets stored in the container toward the roller and to be pivotable about a presser-plate pivot shaft parallel to the rotation shaft, wherein the presser plate includes a bend portion disposed between: a downstream end of the presser plate in the conveyance direction; and the presser-plate pivot shaft, the bend portion being bent or bendable, wherein a distal portion which is a portion of the presser plate ranging from the downstream end to the bend portion and which faces the roller and a basal portion which is a portion of the presser plate ranging from the bend portion to the presser-plate pivot shaft define a bend angle when the distal portion and the basal portion are bent, the bend angle being an angle defined on one side of the presser plate that is farther from the arm, the bend angle being maintained at an obtuse angel when a state of the container is a first-amount loaded state in which a first amount of the plurality of sheets are loaded on the container, and wherein a contact angle of the arm and the plurality of sheets at a contact position, at which the arm and the plurality of sheets on the presser plate contact, is smaller than a maximum angle in a time period in which the state of the container changes from a maximally loaded state in which a maximal amount of the plurality of sheets are loaded on the container to the first-amount loaded state, the maximum angle being an angle defined by: (i) the basal portion in the maximally loaded state; and (ii) the arm the roller of which contacts the presser plate which is the presser plate in the maximally loaded state and on which it is assumed that the plurality of sheets are not loaded in the maximally loaded state.

BRIEF DESCRIPTION OF THE DRAWINGS

The objects, features, advantages, and technical and industrial significance of the present disclosure will be better understood by reading the following detailed description of embodiments, when considered in connection with the accompanying drawings, in which.

DETAILED DESCRIPTION OF THE EMBODIMENTS

First Embodiment

Figure 1:
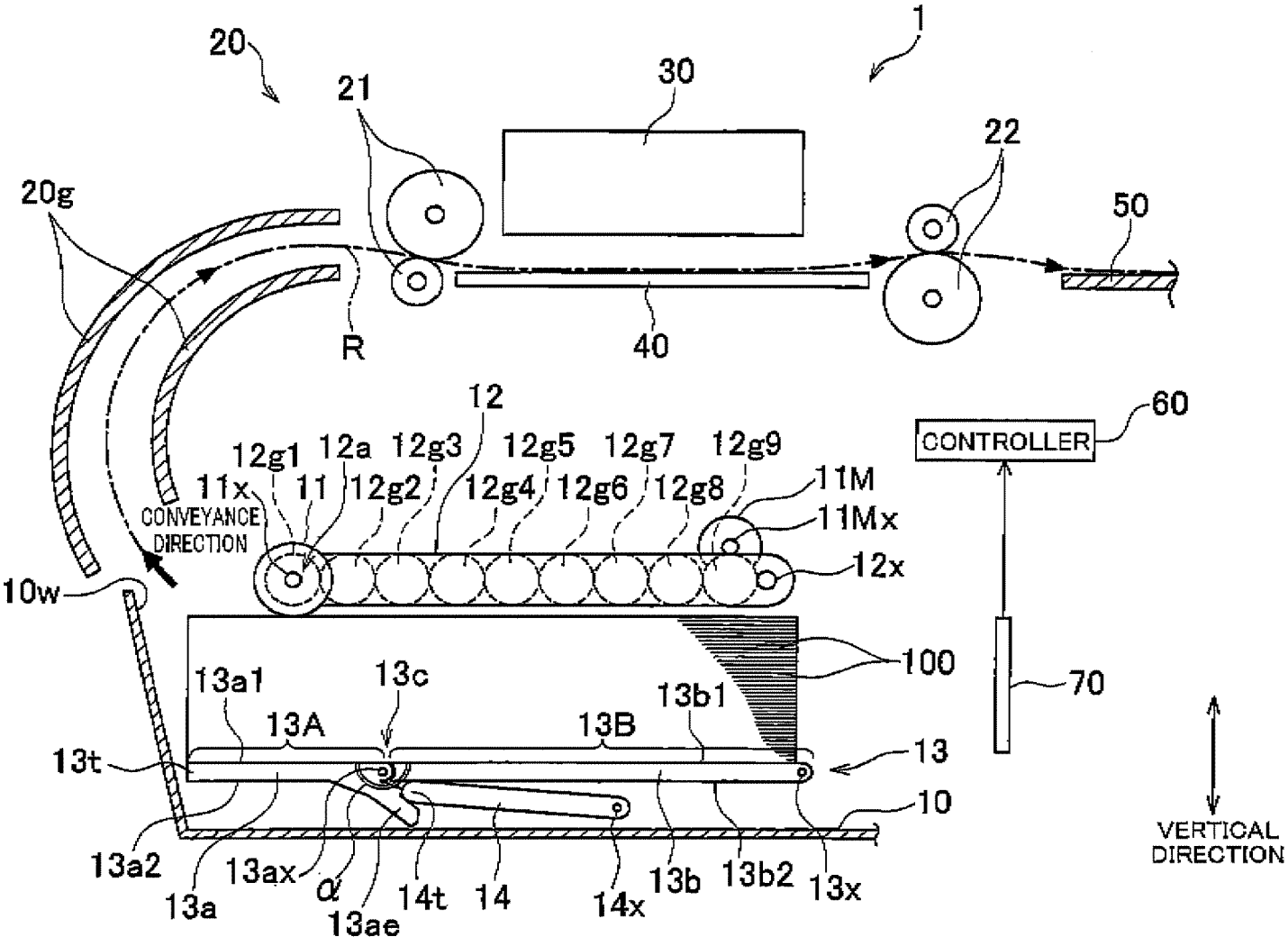
FIG. 1 is a cross-sectional view of a printer according to a first embodiment, the view being taken along a plane parallel to a vertical direction.

As shown in FIG. 1, a printer 1 according to a first embodiment includes: a supply tray 10 capable of storing a stack of a plurality of sheets 100; a conveyor 20 configured to convey an uppermost one of the sheets 100 stored in the supply tray 10 along a conveyance path R; a recording portion 30 configured to perform recording on the sheet 100 conveyed by the conveyor 20; a platen 40 which is opposed to the recording portion 30; an output tray 50 for receiving the sheet 100 which has been conveyed by the conveyor 20; a controller 60 configured to control the conveyor 20, the recording portion 30, and other devices; and a sensor 70 configured to detect an amount of the sheets 100 loaded or stacked on the supply tray 10.

The conveyor 20 includes: a roller 11 disposed so as to be in contact with an uppermost one of the sheets 100 stored in the supply tray 10; a roller pair 21 disposed upstream of the recording portion 30 in the conveyance path R; a roller pair 22 disposed downstream of the recording portion 30 in the conveyance path R; and guide plates 20*g* that define the conveyance path R.

The roller 11 has a rotation shaft 11*x* parallel to the sheets 100 stored in the supply tray 10. The roller 11 rotates about the rotation shaft 11*x* while being in contact with a front surface of the uppermost one of the sheets 100 stored in the supply tray 10, so as to convey the uppermost sheet 100 in a conveyance direction.

The supply tray 10 has a separation wall 10*w*. The separation wall 10*w* is constituted by one of four walls of the supply tray 10 that is located downstream of the roller 11 in the conveyance direction. When a plurality of sheets 100 are supplied by rotation of the miler 11, the separation wall 10*w* contacts one of the plurality of sheets 100 which is farthest from the roller 11 and gives the farthest sheet 100 to a resistance, so as to separate the uppermost sheet 100 from other sheets. To this end, the separation wall 10*w* is provided with a separation member and separation rollers (not shown). The separation member may be a plate member formed of a material having a high frictional resistance such as cork or rubber or may be a member having a plurality of protrusions formed of resin or metal. Feed rollers are disposed so as to be opposed to the separation rollers. The feed rollers always rotate forwardly to convey the sheet 100 in the conveyance direction. The separation rollers rotate forwardly when one sheet 100 is nipped between the separation rollers and the feed rollers and rotate reversely when a plurality of sheets 100 are nipped therebetween.

The rotation shaft 11*x* of the roller 11 is rotatably supported by a distal end (i.e., a supporter 12*a*) of the arm 12. The arm 12 is pivotable about a pivot shaft 12*x* provided at a basal end of the arm 12 located opposite to the distal end while the supporter 12*a* is located downstream of the pivot shaft 12*x* in the conveyance direction. The pivot shaft 12*x* is parallel to the rotation shaft 11*x* and is rotatably supported by a housing (not shown) of the printer 1.

The arm 12 supports gears 12*g*1-12*g*9. The gears 12*g*1-12*g*9 are in mesh with one another. The gear 12*g*1 is fixed to the rotation shaft 11*x*, the gear 12*g*9 is in mesh with a shaft 11Mx of a drive motor 11M, and the gears 12*g*2-12*g*8 connect the gear 12*g*1 and the gear 12*g*9. When the drive motor 11M is driven, the gears 12*g*1-12*g*9 are rotated, so that a drive force of the drive motor 11M is transmitted to the roller 11, and the roller 11 is rotated.

The supply tray 10 pivotably supports: a presser plate 13 for pressing the sheets 100 stored in the supply tray 10 toward the roller 11; and a push-up member 14 for pushing up the presser plate 13 from below so as to pivot the presser plate 13. A pivot shaft 13*x* of the presser plate 13 and a pivot shaft 14*x* of the push-up member 14 are parallel to the rotation shaft 11*x* and are rotatably supported by the supply tray 10. The presser plate 13 is pivotable about the pivot shaft 13*x* while its downstream end 13*t* is located downstream of the pivot shaft 13*x* in the conveyance direction. The push-up member 14 is pivotable about the pivot shaft 14*x* while its downstream end 14*t* is located downstream of the pivot shaft 14*x* in the conveyance direction.

The presser plate 13 includes, between the downstream end 13*t* and the pivot shaft 13*x*, a bend portion 13*c* which is bendable. The presser plate 13 includes a distal member 13*a* shaped like a plate and having the downstream end 13*t* and a basal member 13*b* shaped like a plate and at which the pivot shaft 13*x* is provided. A boundary between the distal member 13*a* and the basal member 13*b* corresponds to the bend portion 13*c*.

Front surfaces 13*a*1, 13*b*1 of the distal member 13*a* and the basal member 13*b* which face the roller 11 respectively constitute a distal region 13A and a basal region 13B. The distal region 13A is a region ranging from the downstream end 13*t* to the bend portion 13*c*. The basal region 13B is a region ranging from the bend portion 13*c* to the pivot shaft 13*x*.

A rotation shaft 13*ax* is provided at an upstream end of the distal member 13*a* which is located opposite to the downstream end 13*t* in the conveyance direction and at which the bend portion 13*c* is provided. The rotation shaft 13*ax* is rotatably supported by a downstream end of the basal member 13*b* which is located opposite to an upstream end of the basal member 13*b* in the conveyance direction at which the pivot shaft 13*x* is provided. That is, the distal member 13*a* and the basal member 13*b* are connected to each other through the bend portion 13*c* such that a bend angle $\alpha$ is changeable. In the present embodiment, the bend angle $\alpha$ is an angle defined, on one side of the presser plate 13 that is farther from the arm 12, by a portion of the presser plate 13 corresponding to the distal region 13A and a portion of the presser plate 13 corresponding to the basal region 13B.

An extending portion 13*ae* is provided on a back surface 13*a*2 (opposite to the front surface 13*a*1) at the upstream end of the distal member 13*a*. The extending portion 13*ae* extends in a direction which intersects the distal region 13A and which is directed from the bend portion 13*c* toward the pivot shaft 13*x*.

The push-up member 14 is configured to pivot about the pivot shaft 14*x* by control of the controller 60 while its downstream end 14*t* is held in contact with the back surface 13*b*2 of the basal member 13*b*, so as to cause the basal member 13*b* to be pivoted about the pivot shaft 13*x*. The controller 60 is configured to receive a signal from the sensor 70 and to drive the pivot shaft 14*x* in accordance with the amount of the sheets 100 stacked on the supply tray 10, thereby controlling a posture of the push-up member 14 and accordingly a posture of the presser plate 13.

Figure 2:
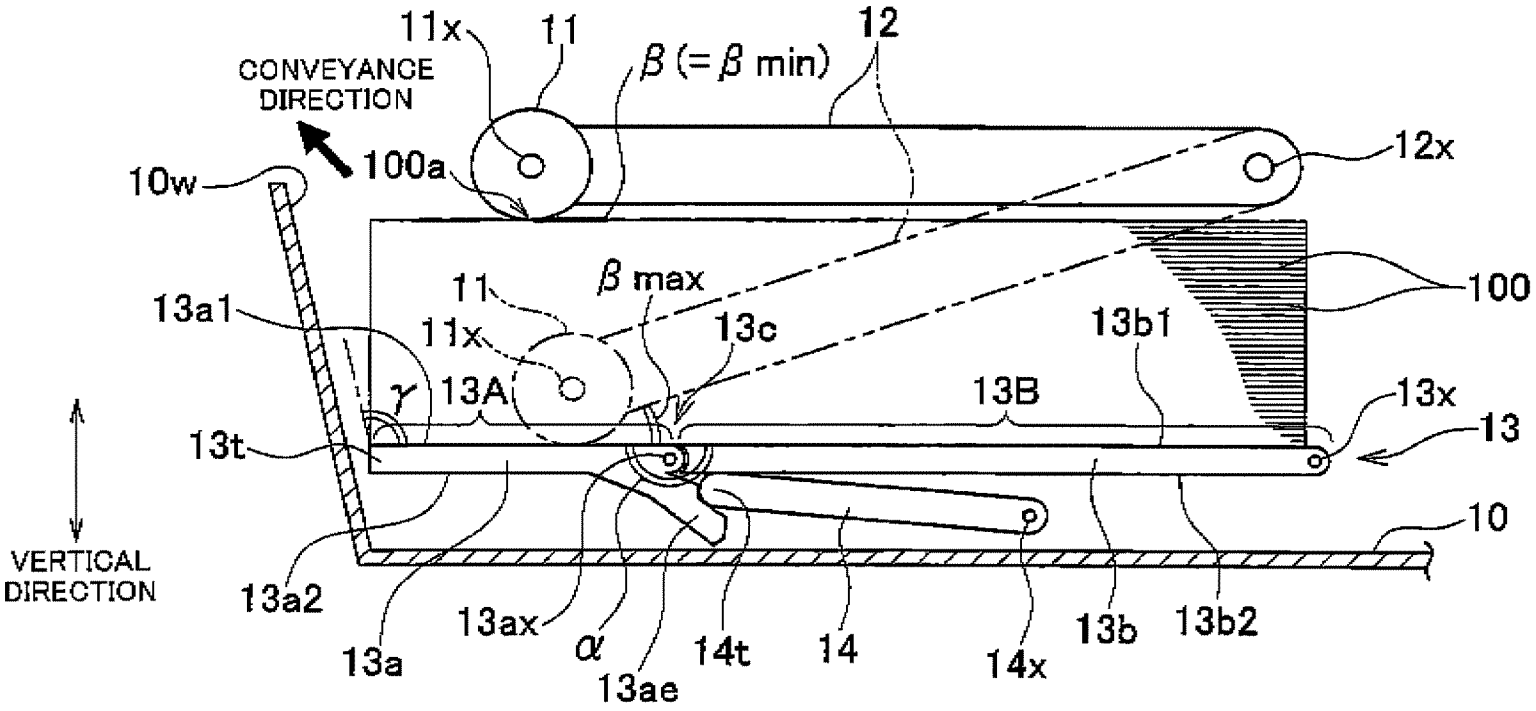
FIG. 2 is a cross-sectional view showing a fully loaded state of a sheet supply tray of the printer according to the first embodiment, the view being taken along the plane parallel to the vertical direction.
Figure 3:
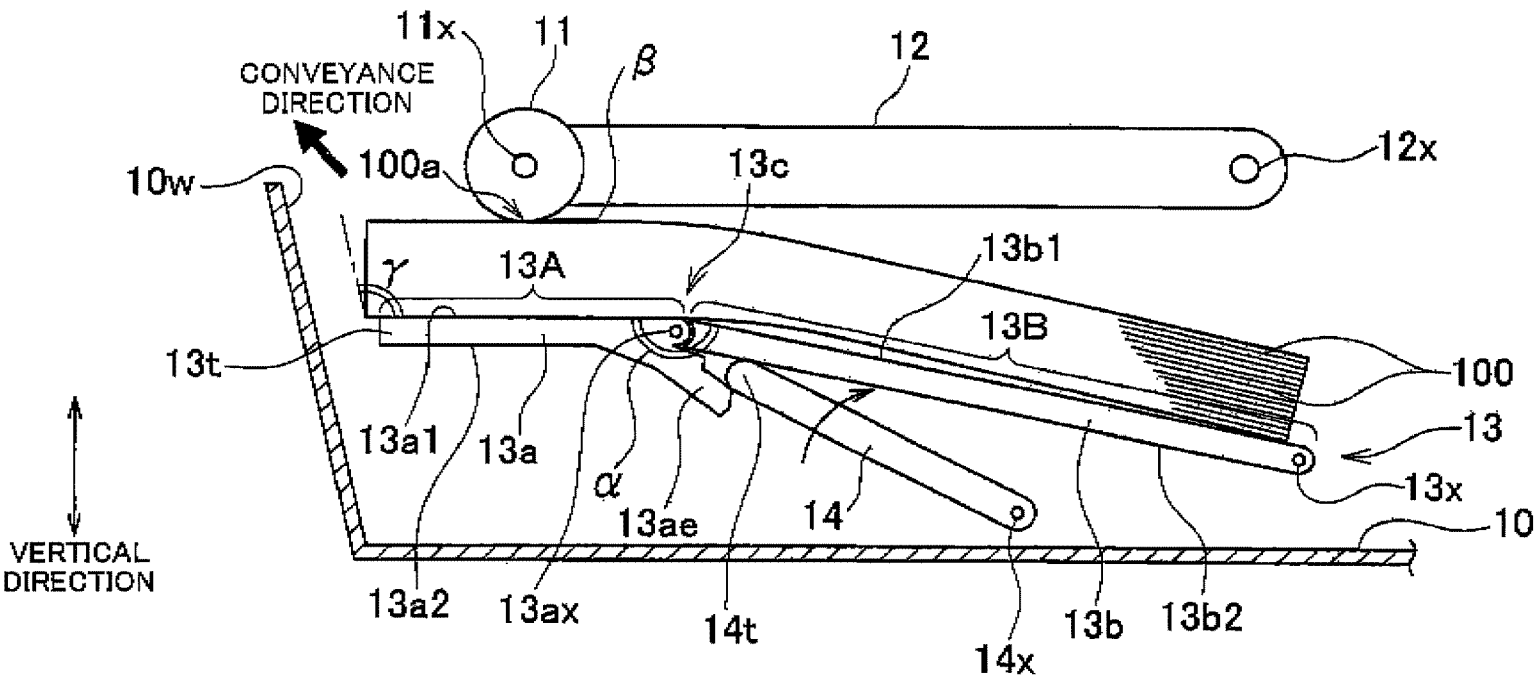
FIG. 3 is a cross-sectional view showing a state of the sheet supply tray of the printer according to the first embodiment in a time period from the fully loaded state till before reaching a near empty state, the view being taken along the plane parallel to the vertical direction.
Figure 4:
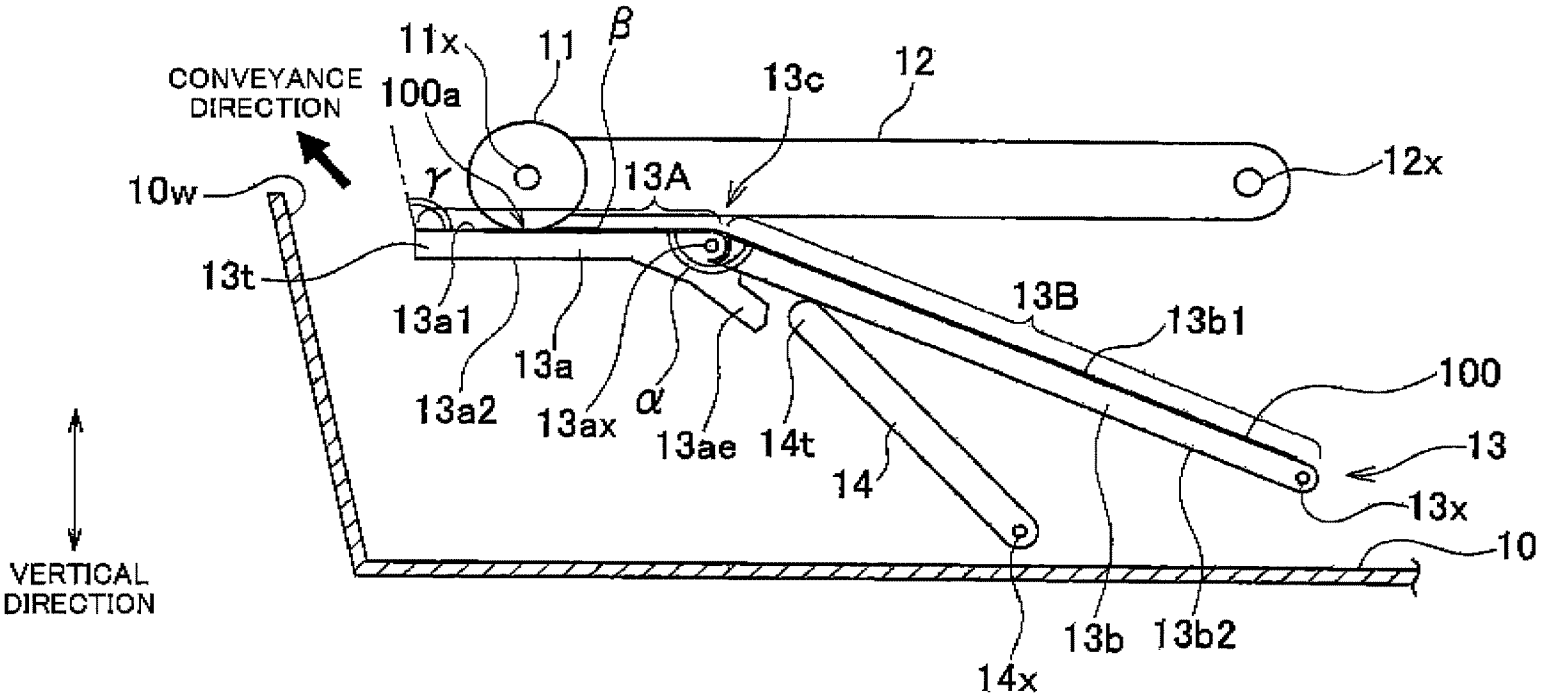
FIG. 4 is a cross-sectional view showing the near empty state of the sheet supply tray of the printer according to the first embodiment, the view being taken along the plane parallel to the vertical direction.

Referring next to FIGS. 2-4, there will be explained operations of the presser plate 13 and the push-up member 14 in a time period in which a state of the supply tray 10 changes from a state in which a maximal amount of the sheets 100 are loaded on the supply tray 10 (hereinafter referred to as "fully loaded state" where appropriate) to a state in which a first amount of the sheets 100 are loaded on the supply tray 10, namely, a single sheet is loaded on the supply tray 10 in the present embodiment (hereinafter referred to as "mar empty state" where appropriate). The fully loaded state is one example of "maximally loaded state", and the near empty state is one example of "first-amount loaded state".

As shown in FIG. 2, the bend angle α is equal to 180° in the fully loaded state. In this instance, the downstream end 14*t* of the push-up member 14 is held and sandwiched by and between the extending portion 13*ae* and the basal member 13*b*.

In a time period from the fully loaded state till before reaching the near empty state, as the amount of the sheets 100 stacked on the supply tray 10 decreases, the push-up member 14 is pivoted by control of the controller 60, as shown in FIG. 3. In this instance, the downstream end 14*t* of the push-up member 14 moves in a direction directed from the bend portion 13*c* toward the pivot shaft 13*x* along the back surface 13*b*2 of the basal member 13*b* while the downstream end 14*t* is interposed between the extending portion 13*ae* and the basal member 13*b*. The push-up member 14 pushes up the downstream end of the basal member 13*b*, whereby the basal member 13*b* is pivoted about the pivot shaft 13*x* toward the arm 12. The downstream end 14*t* and the extending portion 13*ae* are shaped such that, in the time period from the fully loaded state till before reaching the near empty state, the distal member 13*a* is moved upward with its posture kept horizontal and the bend angle α gradually becomes smaller. More specifically, in the time period from the fully loaded state till before reaching the near empty state, the downstream end 14*t* of the push-up member 14 nearer to the bend portion 13*c* is held in contact with both of the basal member 13*b* and the extending portion 13*ae* while being sandwiched therebetween. In this instance, a force received by the distal member 13*a* from the sheets 100 acts on the basal member 13*b* through the extending portion 13*ae* and the push-up member 14. Thus, the posture of the distal member 13*a* is kept horizontal. As shown in FIGS. 2 and 3, in the time period from the fully loaded state till before reaching the near empty state, the downstream end 14*t* of the push-up member 14 is located at a height level higher than the extending portion 13*ae*, and the downstream end of the basal member 13*b* nearer to the bend portion 13*c* is located at a height level higher than the downstream end 14*t* of the push-up member 14. According to the positional relationship among the distal member 13*a*, the basal member 13*b*, and the push-up member 14, the downstream end 14*t* of the push-up member 14 is sandwiched between the basal member 13*b* and the extending portion 13*ae* with high reliability.

At the same time when the near empty state is established, the push-up member 14 moves away from between the extending portion 13*ae* and the basal member 13*b*, and the bend angle α is kept defined by contact of the extending portion 13*ae* and the basal member 13*b*, as shown in FIG. 4. That is, the downstream end 14*t* of the push-up member 14 is spaced apart from the extending portion 13*ae* and is held in contact with the lower surface (the back surface 13*b*2) of the basal member 13*b*.

Thus, the push-up member 14 functions as an angle adjuster for adjusting the bend angle α defined by the distal member 13*a* and the basal member 13*b*.

In the time period in which the state of the supply tray 10 changes from the fully loaded state to the near empty state, namely, in the time period from the fully loaded state to the near empty state, the bend angle α is maintained at an obtuse angle, and the distal region 13A is kept opposed to the roller 11.

In the time period from the fully loaded state to the near empty state, a contact angle β, i.e., an angle defined, on the upstream side in the conveyance direction, by the arm 12 and a roller-contacting portion 100*a* of the sheets 100 on the presser plate 13 which is in contact with the roller 11, is constant (The contact angle β may be referred to as an angle defined by the arm and the sheets at a contact position of the arm and the sheets.) That is, the contact angle β is equal to a minimum angle βmin (which is the contact angle in the fully loaded state and is equal to 0° in the present embodiment). Further, the contact angle β is kept less than a maximum angle βmax which is an angle defined, on the upstream side in the conveyance direction, by: (i) the portion of the presser plate 13 corresponding to the basal region 13B in the fully loaded state; and (ii) the arm 12 the roller 11 of which contacts the presser plate 13 which is the presser plate 13 in the fully loaded state and on which it is assumed that the sheets 100 are not loaded in the fully loaded state, i.e., the arm 12 indicated by the long dashed double-short dashed line in FIG. 2.

An angle γ defined by the portion of the presser plate 13 corresponding to the distal region 13A and the separation wall 10*w* is also kept constant in the time period from the fully loaded state to the near empty state.

As described above, according to the present embodiment, the contact angle β is kept less than the maximum angle βmax in the time period from the fully loaded state to the near empty state, so that it is possible to prevent a plurality of sheets from being conveyed in an overlapping state. In other words, an occurrence of multiple feeding of the sheets is obviated.

In the time period from the fully loaded state to the near empty state, the angle γ defined by the portion of the presser plate 13 corresponding to the distal region 13A and the separation wall 10*w* is kept constant, enabling the sheets to be conveyed with high stability.

In the time period from the fully loaded state to the near empty state, the contact angle β is larger than the minimum angle βmin. When the contact angle β becomes smaller, a pressing force of the roller 11 with respect to the sheets 100 becomes smaller, so that the sheet 100 cannot be conveyed due to a slippage between the roller 11 and the sheet 100 even when the roller 11 is rotated, namely, a feeding failure is likely to occur. According to the configuration in which the contact angle β is larger than the minimum angle βmin in the time period from the fully loaded state to the near empty state, it is possible to prevent or reduce an occurrence of the feeding failure.

In the near empty state, the contact angle β is larger than the minimum angle βmin. In this case, it is possible to prevent or reduce an occurrence of the multiple feeding of the sheets with high reliability in a situation in which the amount of the sheets 100 stacked on the supply tray 10 is small and the multiple feeding of the sheets accordingly tends to occur.

In the time period from the fully loaded state to the near empty state, the contact angle β is larger than the minimum angle βmin. In this case, it is possible to prevent or reduce an occurrence of the multiple feeding of the sheets with high reliability in the time period from the fully loaded state to the near empty state.

The presser plate 13 includes the distal member 13*a* having the distal region 13A and the basal member 13*b* having the basal region 13B. The printer 1 further includes the angle adjuster (which is a mechanism including the push-up member 14) for adjusting the bend angle α defined by the distal member 13*a* and the basal member 13*b*. In this case, the contact angle β can be maintained at an angle less than the maximum angle βmax in the time period from the fully loaded state to the near empty state, with a relatively simple configuration.

The angle adjuster is configured such that, in the time period from the fully loaded state till before reaching the near empty state, the bend angle α is gradually decreased by pivoting the push-up member 14 such that the downstream end 14*t* of the push-up member 14 is moved in the direction directed from the bend portion 13*c* toward the pivot shaft 13*x* while the downstream end 14*t* is interposed between the extending portion 13*ae* and the basal member 13*b*. Further, the angle adjuster is configured such that, when the near empty state is established, the push-up member 14 is moved away from between the extending portion 13*ae* and the basal member 13*b*, and the bend angle α is kept defined by contact of the extending portion 13*ae* and the basal member 13*b*. With this configuration, it is possible to prevent or reduce an occurrence of the feeding failure in the near empty state due to an excessive decrease of the bend angle α. In the first embodiment, at the same time when the near empty state is established, the push-up member 14 is moved away or spaced apart from the extending portion 13*ae*. The push-up member 14 may be spaced apart from the extending portion 13*ae* at other timing. For instance, the push-up member 14 may be spaced apart from the extending portion 13*ae* at a time point earlier than a time point when the state of the supply tray 10 reaches the near empty state. More specifically, in a time period from a first time point at which the state of the supply tray 10 is the fully loaded state to a third time point at which a second amount of the sheets 100 larger than the first amount are loaded on the supply tray 10 and which is earlier than a second time point at which the state of the supply tray 10 reaches the near empty state, the downstream end 14*t* of the push-up member 14 may be held in contact with the basal member 13*b* and the extending portion 13*ae* while being kept interposed therebetween. In a time period from the third time point to the second time point, the downstream end 14*t* of the push-up member 14 may be spaced apart from the extending portion 13*ae*. Also in this configuration, the posture of the distal member 13*a* is kept horizontal from the first time point to the second time point, and the bend angle α of the presser plate 13 is maintained. With this configuration, it is possible to prevent or reduce an occurrence of the feeding failure in the near empty state due to an excessive decrease of the bend angle α.

Second Embodiment

Figure 5:
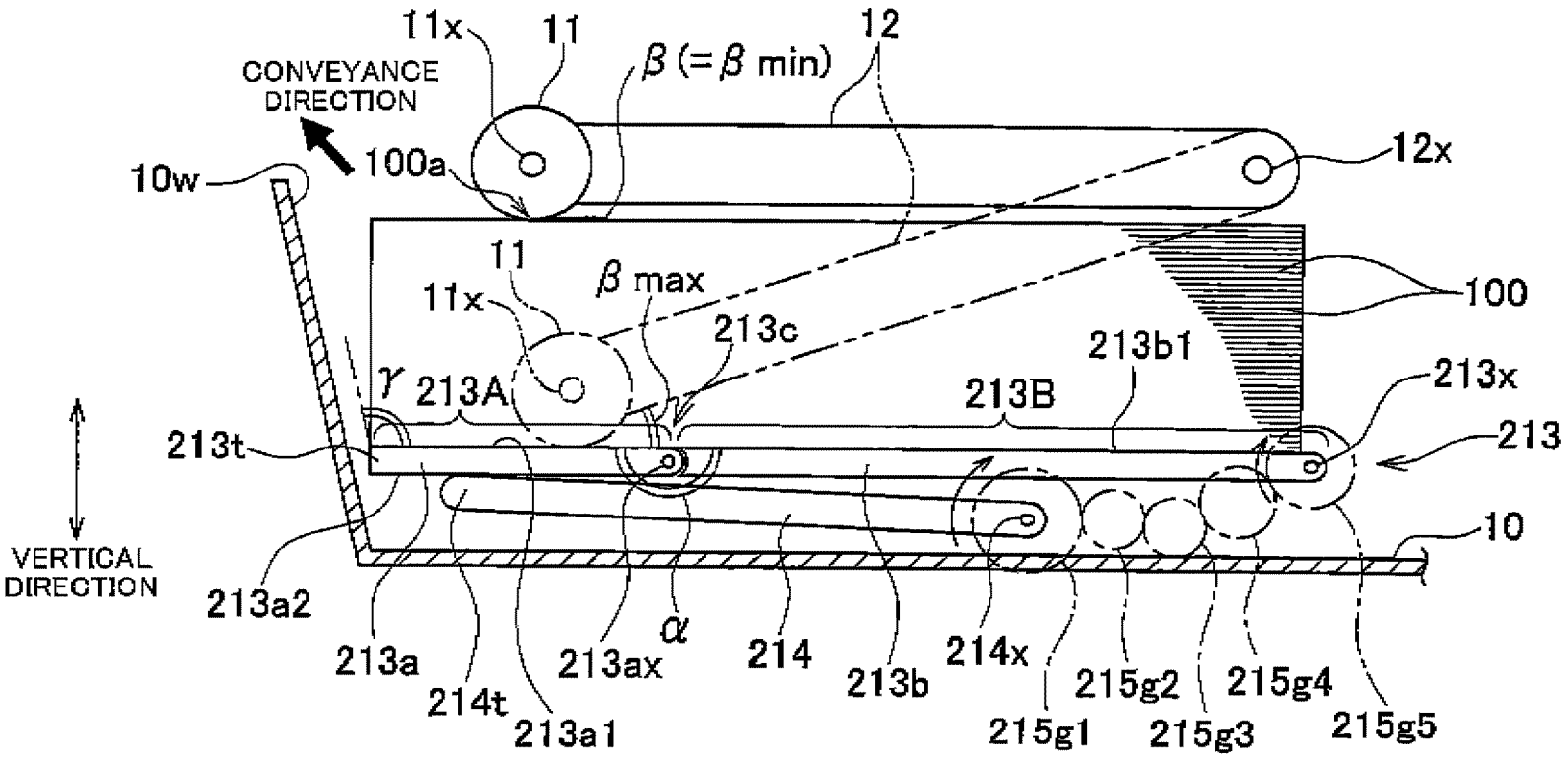
FIG. 5 is a cross-sectional view showing the fully loaded state of the supply tray of a printer according to a second embodiment, the view being taken along the plane parallel to the vertical direction.
Figure 6:
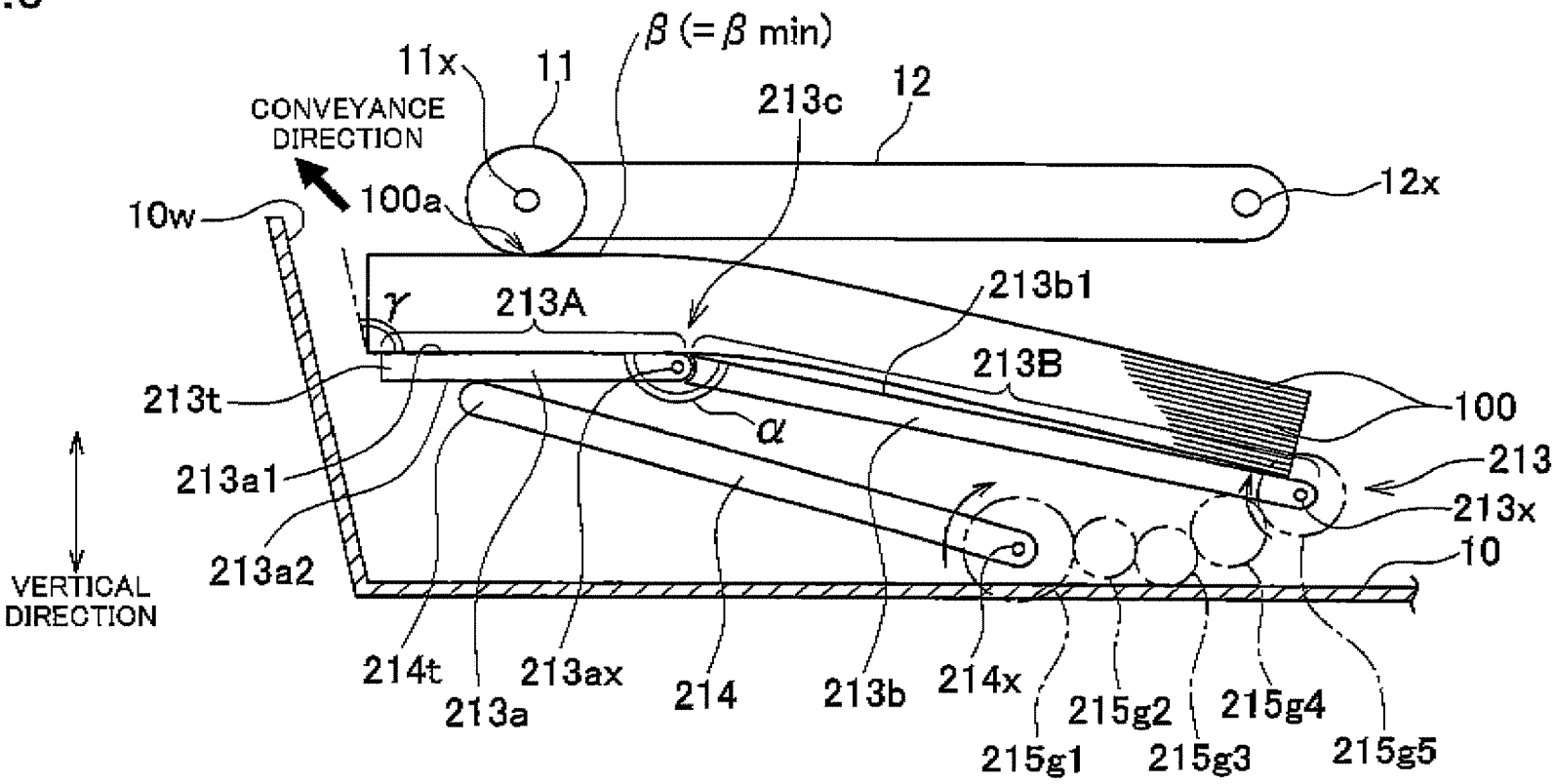
FIG. 6 is a cross-sectional view showing a state of the supply tray of the printer according to the second embodiment in the time period from the fully loaded state till before reaching the near empty state, the view being taken along the plane parallel to the vertical direction.
Figure 7:
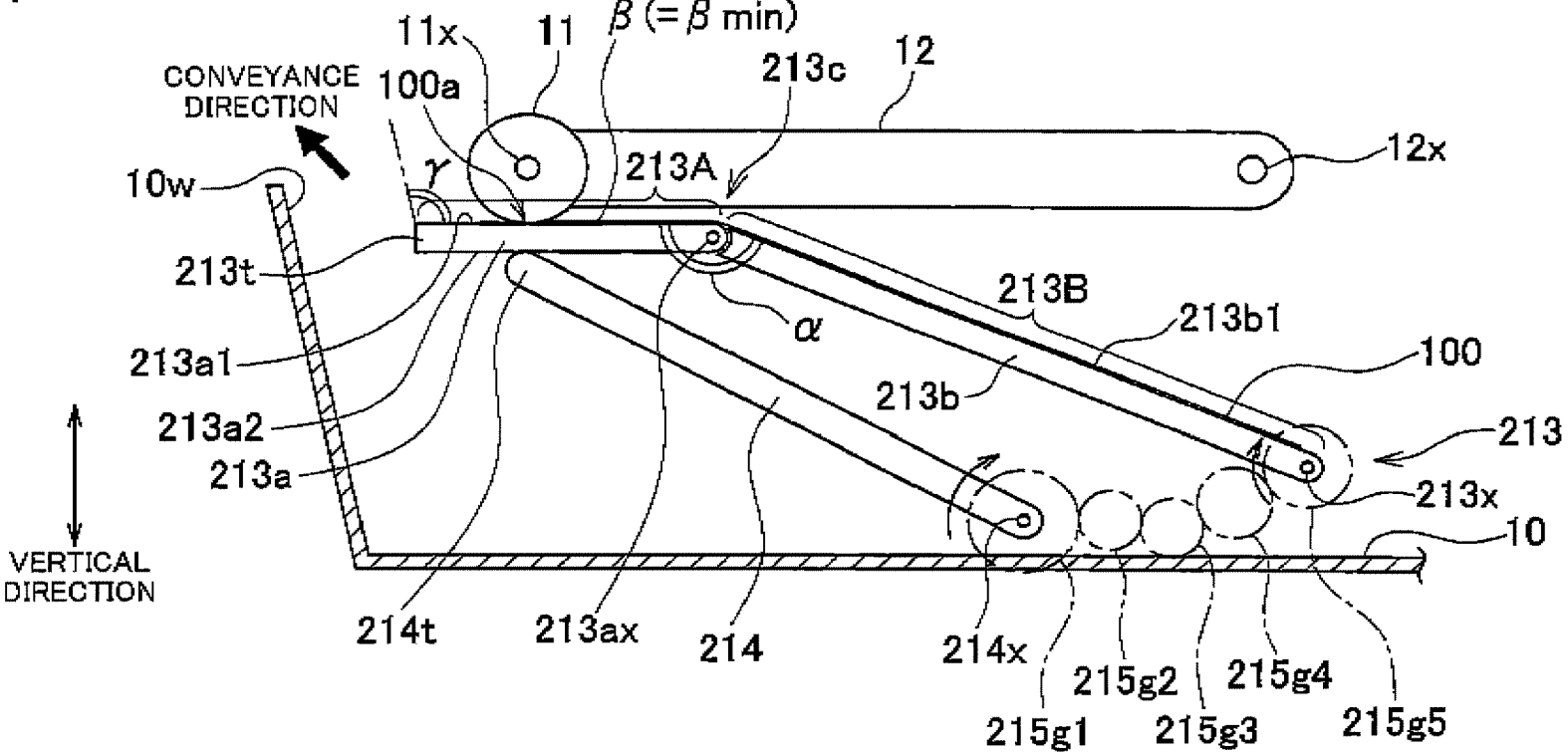
FIG. 7 is a cross-sectional view showing the near empty state of the sheet supply tray of the printer according to the second embodiment, the view being taken along the plane parallel to the vertical direction.

Referring next to FIGS. 5-7, there will be explained a printer according to a second embodiment. The printer of the second embodiment differs from the printer of the first embodiment in structures of the presser plate and the push-up member, and other structures are the same as in the first embodiment.

The supply tray 10 pivotably supports: a presser plate 213 for pressing the sheets 100 stored in the supply tray 10 toward the roller 11; and a push-up member 214 for pushing up the presser plate 213 from below so as to pivot the presser plate 213. A pivot shaft 213*x* of the presser plate 213 and a pivot shaft 214*x* of the push-up member 214 are parallel to the rotation shaft 11*x* and are rotatably supported by the supply tray 10. The presser plate 213 is pivotable about the pivot shaft 213*x* while its downstream end 213*t* is located downstream of the pivot shaft 213*x* in the conveyance direction. The push-up member 214 is pivotable about the pivot shaft 214*x* while its downstream end 214*t* is located downstream of the pivot shaft 214*x* in the conveyance direction.

The presser plate 213 includes, between the downstream end 213*t* and the pivot shaft 213*x*, a bend portion 213*c* which is bendable. The presser plate 213 includes a distal member 213*a* shaped like a plate and having the downstream end 213*t* and a basal member 213*b* shaped like a plate and at which the pivot shaft 213*x* is provided. A boundary between the distal member 213*a* and the basal member 213*b* corresponds to the bend portion 213*c*.

Front surfaces 213*a*1, 213*b*1 of the distal member 213*a* and the basal member 213*b* which face the roller 11 respectively constitute a distal region 213A and a basal region 213B. The distal region 213A is a region ranging from the downstream end 213*t* to the bend portion 213*c*. The basal region 213B is a region ranging from the bend portion 213*c* to the pivot shaft 213*x*.

A rotation shaft 213*ax* is provided at an upstream end of the distal member 213*a* which is located opposite to the downstream end 213*t* in the conveyance direction and at which the bend portion 213*c* is provided. The rotation shaft 213*ax* is rotatably supported by a downstream end of the basal member 213*b* which is located opposite to an upstream end of the basal member 213*b* in the conveyance direction at which the pivot shaft 213*x* is provided. That is, the distal member 213*a* and the basal member 213*b* are connected to each other through the bend portion 213*c* such that a bend angle α is changeable. In the present embodiment, the bend angle α is an angle defined by a portion of the presser plate 213 corresponding to the distal region 213A and a portion of the presser plate 213 corresponding to the basal region 213B, on one side of the presser plate 213 that is farther from the arm 12.

The push-up member 214 is configured to pivot about the pivot shaft 214*x* by control of the controller 60 while its downstream end 214*t* is held in contact with a back surface 213*a*2 of the distal member 213*a* (which is opposite to the front surface 213*a*1), so as to push up the distal member 213*a*. The controller 60 is configured to receive a signal from the sensor 70 and to drive the pivot shaft 214*x* in accordance with the amount of the sheets 100 stacked on the supply tray 10, thereby controlling a posture of the push-up member 214 and accordingly a posture of the presser plate 213.

The pivot shafts 213*x*, 214*x* are connected through the gears 215*g*1-215*g*5. The gears 215*g*1-215*g*5 are in mesh with one another. The gear 215*g*1 is fixed to the pivot shaft 214*x*, the gear 215*g*5 is fixed to the pivot shaft 213*x*, and the gears 215*g*2-215*g*4 connect the gear 215*g*1 and the gear 215*g*5. When the pivot shaft 214*x* is driven, the gears 215*g*1-215*g*5 are rotated, and rotation of the pivot shaft 214*x* is transmitted to the pivot shaft 213*x*, so that the pivot shaft 213*x* is rotated. While the pivot shaft 214*x* is driven in the present embodiment, the pivot shaft 213*x* may be driven. In this case, when the pivot shaft 213*x* is driven, the gears 215*g*1-215*g*5 are rotated, and rotation of the pivot shaft 213*x* is transmitted to the pivot shaft 214*x*, so that the pivot shaft 214*x* is rotated.

In other words, the gears 215*g*1-215*g*5 correspond to a transmission member configured to perform: transmission of a pivotal movement of the push-up member 214 about the pivot shaft 214*x* to a pivotal movement of the basal member 213*b* about the pivot shaft 213*x*; and transmission of the pivotal movement of the basal member 213*b* about the pivot shaft 213*x* to the pivotal movement of the push-up member 214 about the pivot shaft 214*x*. The drive force is transmitted by the gears 215*g*1-215*g*5, so that the basal member 213*b* and the push-up member 214 operate in conjunction with each other.

There will be next explained operations of the presser plate 213 and the push-up member 214 in the time period from the fully loaded state (in which the maximal amount of the sheets 100 are loaded on the supply tray 10) to the near empty state (in which the first amount of the sheets 100 are loaded on the supply tray 10, namely, a single sheet is loaded on the supply tray 10 in the present embodiment).

As shown in FIG. 5, the bend angle α is equal to 180° in the fully loaded state.

In the time period from the fully loaded state till before reaching the near empty state, as the amount of the sheets 100 stacked on the supply tray 10 decreases, the push-up member 214 is pivoted by control of the controller 60, as shown in FIG. 6. In this instance, the downstream end 214*t* of the push-up member 214 moves in a direction directed from the downstream end 213*t* toward the bend portion 213*e* along the back surface 213*a*2 of the distal member 213*a*. The gears 215*g*1-215*g*5 transmit the drive force of the pivot shaft 214*x* to the pivot shaft 213*x*, so that the basal member 213*b* is pivoted about the pivot shaft 213*x* toward the arm 12. The gear ratio is set such that, in the time period from the fully loaded state till before reaching the near empty state, the distal member 213*a* is moved upward with its posture kept horizontal and the bend angle α gradually becomes smaller.

Thus, the push-up member 214 and the gears 215*g*1-215*g*5 function as an angle adjuster for adjusting the bend angle α defined by the distal member 213*a* and the basal member 213*b*.

In the time period from the fully loaded state to the near empty state, the bend angle α is maintained at an obtuse angle, and the distal region 213A is kept opposed to the roller 11.

In the time period from the fully loaded state to the near empty state, a contact angle β, i.e., an angle defined, on the upstream side in the conveyance direction, by the arm 12 and the roller-contacting portion 100*a* of the sheets 100 on the presser plate 213 which is in contact with the roller 11, is constant. That is, the contact angle β is equal to the minimum angle βmin (which is the contact angle in the fully loaded state and is equal to 0° in the present embodiment). Further, the contact angle β is kept less than a maximum angle βmax which is an angle defined, on the upstream side in the conveyance direction, by: (i) the portion of the presser plate 213 corresponding to the basal region 213B in the fully loaded state; and (ii) the arm 12 the roller 11 of which contacts the presser plate 213 which is the presser plate 213 in the fully loaded state and on which it is assumed that the sheets 100 are not loaded in the fully loaded state, i.e., the arm 12 indicated by the long dashed double-short dashed line in FIG. 5.

An angle γ defined by the portion of the presser plate 213 corresponding to the distal region 213A and the separation wall 10*w* is also kept constant in the time period from the fully loaded state to the near empty state.

As described above, the present embodiment offers the same advantages as those offered by the first embodiment according to the same configuration as employed in the first embodiment. The second embodiment further offers the following advantages.

The angle adjuster includes the gears 215*g*1-215*g*5 that permit the basal member 213*b* and the push-up member 214 to operate in conjunction with each other. With this configuration, it is not necessary to individually drive the basal member 213*b* and the push-up member 214, resulting in a decrease in the number of drive sources.

Third Embodiment

Figure 8:
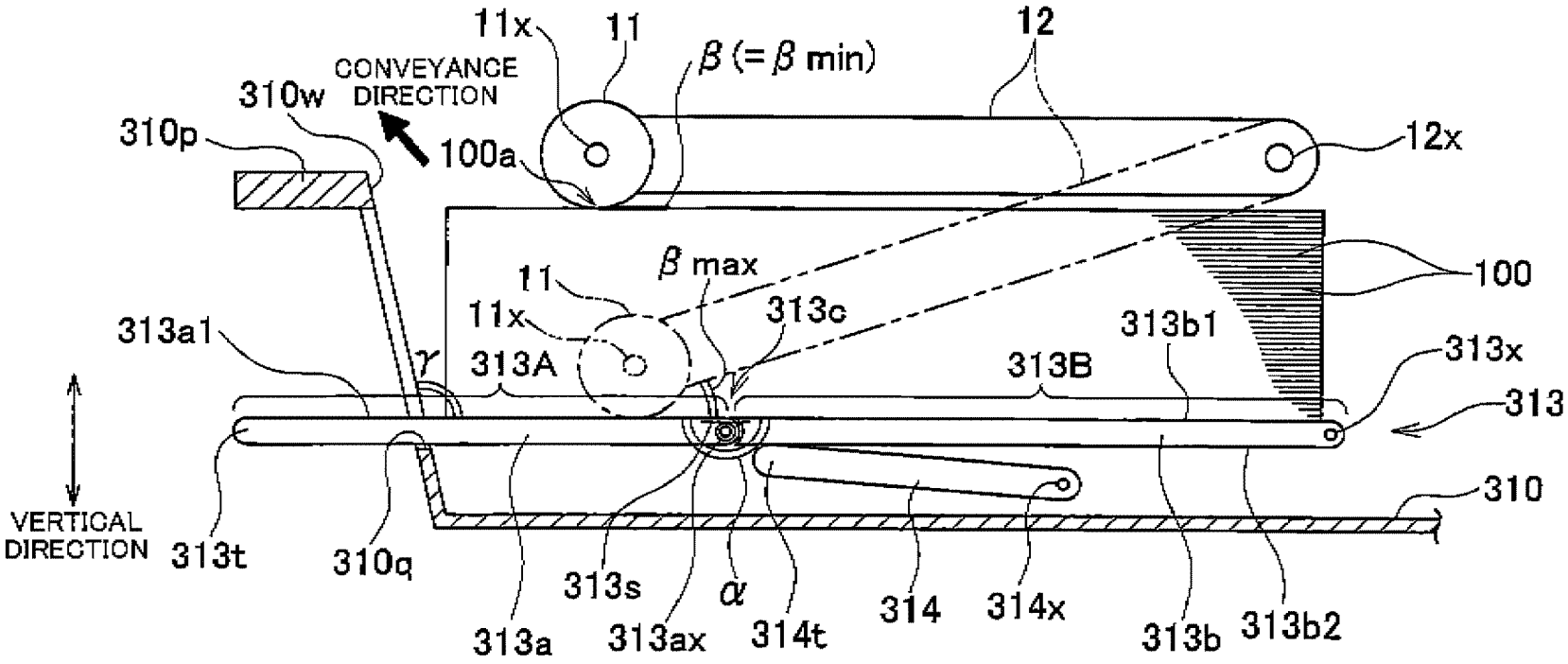
FIG. 8 is a cross-sectional view showing the fully loaded state of the supply tray of a printer according to a third embodiment, the view being taken along the plane parallel to the vertical direction.
Figure 9:
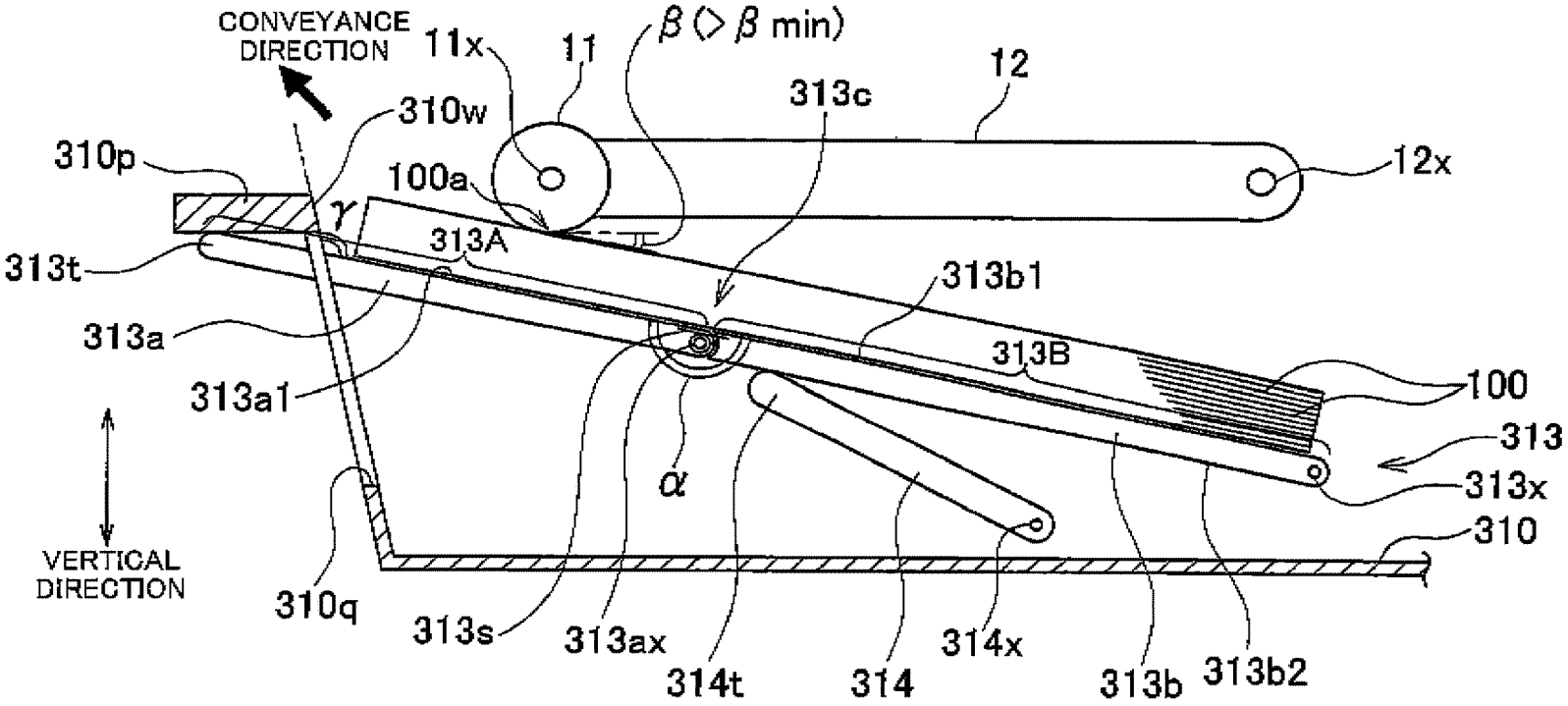
FIG. 9 is a cross-sectional view showing a state of the sheet supply tray of the printer according to the third embodiment in the time period from the fully loaded state till before reaching the near empty state, the view being taken along the plane parallel to the vertical direction.
Figure 10:
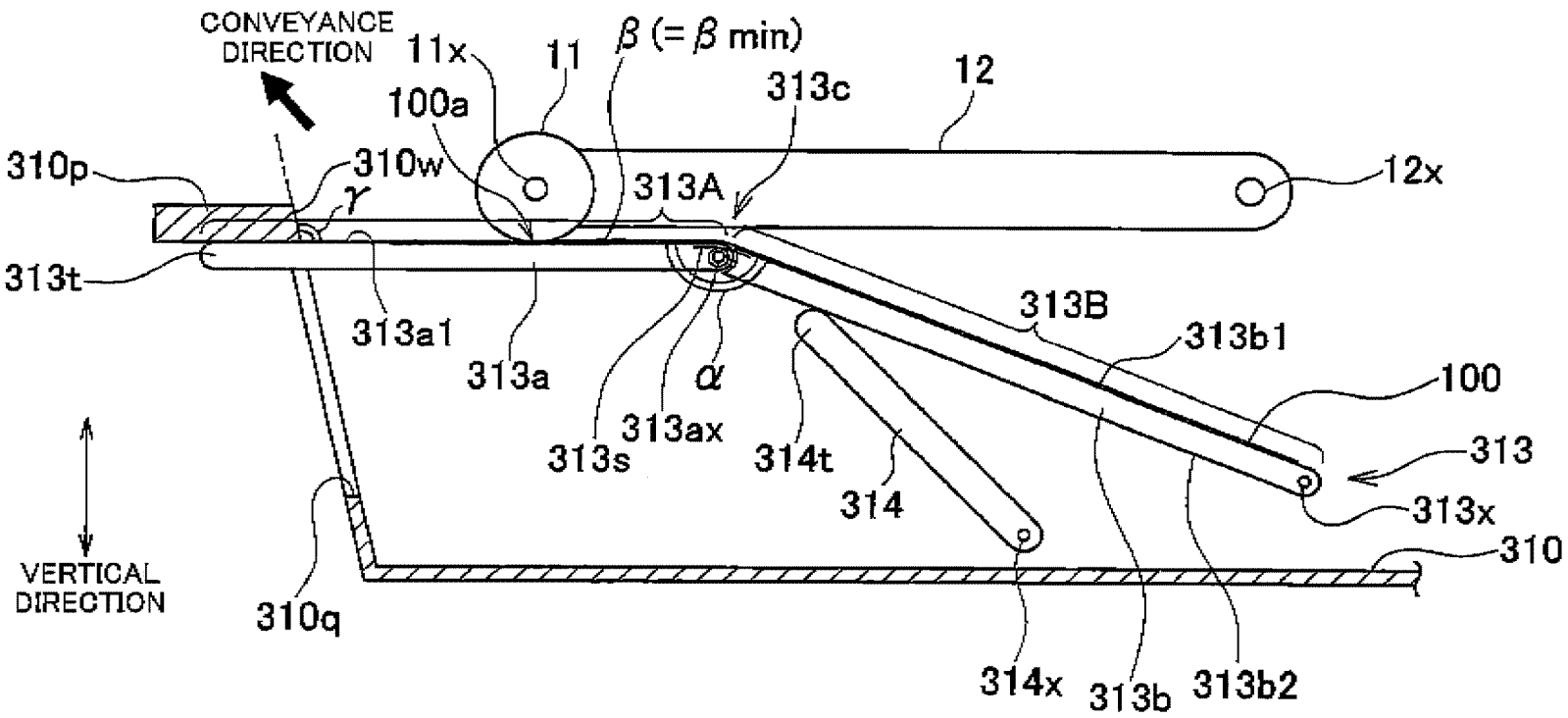
FIG. 10 is a cross-sectional view showing the near empty state of the sheet supply tray of the printer according to the third embodiment, the view being taken along the plane parallel to the vertical direction.

Referring next to FIGS. 8-10, there will be explained a printer according to a third embodiment. The printer of the third embodiment differs from the printer of the first embodiment in structures of the presser plate, the push-up member, and the supply tray, and other structures are the same as in the first embodiment.

A supply tray 310 has: a protruding portion 310*p* (as one example of "limiter") that protrudes outward from an upper end of the separation wall 310*w*; and a through-hole 310*q* formed in the separation wall 310*w*.

The supply tray 310 pivotably supports: a presser plate 313 for pressing the sheets 100 stored in the supply tray 310 toward the roller 11; and a push-up member 314 for pushing up the presser plate 313 from below so as to pivot the presser plate 313. A pivot shaft 313*x* of the presser plate 313 and a pivot shaft 314*x* of the push-up member 314 are parallel to the rotation shaft 11*x* and are rotatably supported by the supply tray 310. The presser plate 313 is pivotable about the pivot shaft 313*x* while its downstream end 313*t* is located downstream of the pivot shaft 313*x* in the conveyance direction. The push-up member 314 is pivotable about the pivot shaft 314*x* while its downstream end 314*t* is located downstream of the pivot shaft 314*x* in the conveyance direction.

The presser plate 313 includes, between the downstream and 313*t* and the pivot shaft 313*x*, a bend portion 313*c* which is bendable. The presser plate 313 includes a distal member 313*a* shaped like a plate and having the downstream end 313*t* and a basal member 313*b* shaped like a plate and at which the pivot shaft 313*x* is provided. A boundary between the distal member 313*a* and the basal member 313*b* corresponds to the bend portion 313*c*.

Front surfaces 313*a*1, 313*b*1 of the distal member 313*a* and the basal member 313*b* which face the roller 11 respectively constitute a distal region 313A and a basal region 313B. The distal region 313A is a region ranging from the downstream end 313*t* to the bend portion 313*c*. The basal region 313B is a region ranging from the bend portion 313*c* to the pivot shaft 313*x*.

A rotation shaft 313*ax* is provided at an upstream end of the distal member 313*a* which is located opposite to the downstream and 313*t* in the conveyance direction and at which the bend portion 313*c* is provided. The rotation shaft 313*ax* is rotatably supported by a downstream end of a basal member 313*b* which is located opposite to an upstream end of the basal member 313*b* in the conveyance direction at which the pivot shaft 313*x* is provided. That is, the distal member 313*a* and the basal member 313*b* are connected to each other through the bend portion 313*c* such that a bend angle α is changeable. In the present embodiment, the bend angle α is an angle defined by a portion of the presser plate 313 corresponding to the distal region 313A and a portion of the presser plate 313 corresponding to the basal region 313B, on one side of the presser plate 313 that is farther from the arm 12.

The rotation shaft 313*ax* is provided with a spring 313*s* (as one example of "biasing member"). The spring 313*s* biases the distal member 313*a* and the basal member 313*b* in a direction to increase the bend angle α. A stopper (not shown) is disposed at the bend portion 313*c* of the presser plate 313 for preventing the bend angle α from becoming larger than 180°.

The push-up member 314 is configured to pivot about the pivot shaft 314*x* by control of the controller 60 while its downstream end 314*t* is held in contact with a back surface 313*b*2 of the basal member 313*b* (which is opposite to the front surface 313*b*1 thereof), so as to cause the basal member 313*b* to be pivoted about the pivot shaft 313*x*. The controller 60 is configured to receive a signal from the sensor 70 and to drive the pivot shaft 314*x* in accordance with the amount of the sheets 100 stacked on the supply tray 310, thereby controlling a postured of the push-up member 314 and accordingly a posture of the presser plate 313.

There will be next explained operations of the presser plate 313 and the push-up member 314 in the time period from the fully loaded state (in which the maximal amount of the sheets 100 are loaded on the supply tray 310) to the near empty state (in which the first amount of the sheets 100 are loaded on the supply tray 310, namely, a single sheet is loaded on the supply tray 10 in the present embodiment).

As shown in FIG. 8, the bend angle α is equal to 180° in the fully loaded state. In this instance, the distal member 313*a* is supported by a lower surface that defines the through-hole 310*q* formed in the separation wall 310*w*.

In the time period from the fully loaded state till before reaching the near empty state, as the amount of the sheets 100 stacked on the supply tray 310 decreases, the push-up member 314 is pivoted by control of the controller 60, as shown in FIG. 9. In this instance, the downstream end 314*t* of the push-up member 314 moves in a direction directed from the bend portion 313*c* toward the pivot shaft 313*x* along the back surface 313*b*2 of the basal member 313*b*. The push-up member 314 pushes up the downstream end of the basal member 313*b*, whereby the basal member 313*b* is pivoted about the pivot shaft 313*x* toward the arm 12.

In a process in which the state of the supply tray 10 changes from the fully loaded state to the near empty state, the distal member 313*a* is moved upward with its posture kept parallel to the basal member 313*b* until the downstream end 313*t* of the presser plate 313 comes into contact with the protruding portion 310*p*. The bend angle α is constant until the downstream end 313*t* of the presser plate 313 comes into contact with the protruding portion 310*p*. In a time period from a time point when the downstream end 313*t* comes into contact with the protruding portion 310*p* till before reaching the near empty state, the basal member 313*b* is pushed up by the push-up member 314 in a state in which the downstream end 313*t* of the distal member 313*a* is inhibited from moving upward by the protruding portion 310*p*, whereby the bend angle α is gradually decreased against the biasing force of the spring 313*s*, as shown in FIG. 10.

Thus, the spring 313*s*, the push-up member 314, and the protruding portion 310*p* function as an angle adjuster for adjusting the bend angle α defined by the distal member 313*a* and the basal member 313*b*.

In the time period from the fully loaded state to the near empty state, the bend angle α is maintained at an obtuse angle, and the distal region 313A is kept opposed to the roller 11.

In the time period from the fully loaded state to the near empty state, a contact angle β, i.e., an angle defined, on the upstream side in the conveyance direction, by the arm 12 and the roller-contacting portion 100*a* of the sheets 100 on the presser plate 313 which is in contact with the roller 11, is kept less than a maximum angle βmax but is not constant. Here the maximum angle βmax is an angle defined, on the upstream side in the conveyance direction, by (i) the portion of the presser plate 313 corresponding to the basal region 313B in the fully loaded state and (ii) the arm 12 the roller 11 of which contacts the presser plate 313 which is the presser plate 313 in the fully loaded state and on which it is assumed that the sheets 100 are not loaded in the fully loaded state, i.e., the arm 12 indicated by the long dashed double-short dashed line in FIG. 8. In the present embodiment, the contact angle β is gradually increased from the fully loaded state till the time point when the downstream end 313*t* comes into contact with the protruding portion 310*p* and becomes larger than the minimum angle βmin (which is the contact angle in the fully loaded state and is equal to 0° in the present embodiment). However, the contact angle is gradually decreased in the time period from the time point when the downstream end portion 313*t* comes into contact with the protruding portion 310*p* till before reaching the near empty state, and becomes equal to the minimum angle βmin in the near empty state.

In the present embodiment, an angle γ defined by the portion of the presser plate 313 corresponding to the distal region 313A and the separation wall 10*w* is not constant, either, from the fully loaded state to the near empty state. The angle γ is gradually increased from the fully loaded state till the time point when the downstream end 313*t* comes into contact with the protruding portion 310*p*, and is gradually decreased in the time period from the time point when the downstream end 313*t* comes into contact with the protruding portion 310*p* till before reaching the near empty state. The angle γ in the near empty state is equal to the angle γ in the fully loaded state.

As described above, the present embodiment offers the same advantages as those offered by the first embodiment according to the same configuration as employed in the first embodiment. The third embodiment further offers the following advantages.

The angle adjuster includes the spring 313*s* provided at the bend portion 313*c*, the push-up member 314 configured to pivot the basal member 313*b* about the pivot shaft 313*x*, and the protruding portion 310*p* configured to limit the movement of the downstream end 313*t* With this configuration, the bend angle α is effectively adjusted by a cooperative operation of the spring 313*s*, the push-up member 314, and the protruding portion 310*p*.

While the embodiments of the disclosure have been described above, it is to be understood that the disclosure is not limited to the details of the illustrated embodiments, but may be embodied with other various changes and modifications, which may occur to those skilled in the art, without departing from the scope of the disclosure.

The presser plate does not necessarily have to support the entirety of the sheets, but may support a part of the sheets (including a portion facing the roller). In this case, other part of the sheets may be supported directly by the container.

The contact angle is an angle defined, on the upstream side in the conveyance direction, by a plane that includes the arm and a plane along the roller-contacting portion of the sheets on the presser plate which is in contact with the roller. The contact angle is equal to 0° when these planes are in parallel with each other as shown in FIGS. 2-8 and 10. The contact angle may be a positive value (FIG. 9) or a negative value.

The distal region need not necessarily extend in the horizontal direction in the near empty state.

In the second embodiment, the gears 215*g*1-215*g*5 (the transmission member) perform both of: transmission of the pivotal movement of the push-up member 214 about the pivot shaft 214*x* to the pivotal movement of the basal member 213*b* about the pivot shaft 213*x*; and transmission of the pivotal movement of the basal, member 213*b* about the pivot shaft 213*x* to the pivotal movement of the push-up member 214 about the pivot shaft 214*x*. The transmission member may perform only one of the transmissions.

In the second embodiment, the transmission member may be omitted, and the basal member and the push-up member may be individually driven. In this case, it is preferable to individually control driving of the basal member and driving of the push-up member such that, in the time period from the fully loaded state to the near empty state, the distal member 213*a* moves upward with its posture kept horizontal and the bend angle α is gradually decreased.

In place of the sensor 70 for detecting the amount of the sheets 100 loaded on the supply tray, a sensor for detecting an angle of the arm 12 may be used, for instance. In this case, the controller 60 may be configured to receive a signal from the sensor and to control the postures of the push-up member and the presser plate such that the angle of the arm 12 is kept constant, namely, the arm 12 is kept horizontal, for instance.

The push-up member may be omitted, and the rotation shaft of the basal member provided at the distal member and the presser-plate pivot shaft provided at the basal member may be coupled to gears. In this case, when the presser-plate pivot shaft is driven and the basal member pivots about the presser-plate pivot shaft, the drive force of the presser-plate pivot shaft is transmitted to the rotation shaft by the gears, so that the distal member pivots about the rotation shaft.

It is not necessarily required that the presser plate is constituted by a plurality of members connected to each other and the bend angle is adjustable. The presser plate may be constituted by a single member, and the bend angle may be kept constant.

In the illustrated embodiments, the arm is supported by the housing of the sheet conveying apparatus. The arm may be supported by the container.

The recording portion may be an ink-jet type, a thermal type, or a laser type. The sheet conveying apparatus according to the disclosure is not limited to the printer, but may be a facsimile, a copying machine, or a multi-function peripheral (MFP), for instance. The sheet conveying apparatus does not necessarily have to have the recording portion. The sheet is not limited to paper but may be a cloth, for instance.

What is claimed is:

1. A sheet conveying apparatus, comprising:

a container for storing a stack of a plurality of sheets;

a roller rotatable about a rotation shaft parallel to the plurality of sheets stored in the container and configured to convey the plurality of sheets one by one in a conveyance direction by rotating about the rotation shaft while being held in contact with a front surface of the plurality of sheets stored in the container;

an arm including a supporter that rotatably supports the roller, the arm being pivotable about an arm pivot shaft parallel to the rotation shaft while the supporter is located downstream of the arm pivot shaft in the conveyance direction, and a presser plate configured to press the plurality of sheets stored in the container toward the roller and to be pivotable about a presser-plate pivot shaft parallel to the rotation shaft, wherein the presser plate includes a bend portion disposed between: a downstream end of the presser plate in the conveyance direction; and the presser-plate pivot shaft, the bend portion being bent or bendable, wherein a distal portion which is a portion of the presser plate ranging from the downstream end to the bend portion and which faces the roller and a basal portion which is a portion of the presser plate ranging from the bend portion to the presser-plate pivot shaft define a bend angle when the distal portion and the basal portion are bent, the bend angle being an angle defined on one side of the presser plate that is farther from the arm, the bend angle being maintained at an obtuse angel when a state of the container is a first-amount loaded state in which a first amount of the plurality of sheets are loaded on the container, wherein a contact angle of the arm and the plurality of sheets at a contact position, at which the arm and the plurality of sheets on the presser plate contact, is smaller than a maximum angle in a time period in which the state of the container changes from a maximally loaded state in which a maximal amount of the plurality of sheets are loaded on the container to the first-amount loaded state, the maximum angle being an angle defined by: (i) the basal portion in the maximally loaded state; and (ii) the arm the roller of which contacts the presser plate which is the presser plate in the maximally loaded state and on which it is assumed that the plurality of sheets are not loaded in the maximally loaded state, wherein the presser plate includes a distal member that constitutes the distal portion and a basal member that constitutes the basal portion, and wherein the presser plate includes an angle adjuster configured to adjust the bend angle defined by the distal member and the basal member such that the bend angle is maintained at an obtuse angle.

2. The sheet conveying apparatus according to claim 1, wherein the container includes a separation wall disposed downstream of the roller in the conveyance direction and configured such that, when the plurality of sheets are conveyed by rotation of the roller, the separation wall comes into contact with one of the plurality of sheets which is farthest from the roller and gives a resistance to the one of the plurality of sheets which is farthest from the roller, so as to separate the sheets, and wherein the presser plate is configured such that an angle defined by the distal portion and the separation wall is kept constant in the time period in which the state of the container changes from the maximally loaded state to the first-amount loaded state.

3. The sheet conveying apparatus according to claim 1, wherein the presser plate is configured such that the contact angle in the time period in which the state of the container changes from the maximally loaded state to the first-amount loaded state is not smaller than a minimum angle which is the contact angle in the maximally loaded state.

4. The sheet conveying apparatus according to claim 3, wherein the presser plate is configured such that the contact angle when the state of the container is the first-amount loaded state is equal to the minimum angle.

5. The sheet conveying apparatus according to claim 3, wherein the presser plate is configured such that the contact angle in the time period in which the state of the container changes from the maximally loaded state to the first-amount loaded state is equal to the minimum angle.

6. The sheet conveying apparatus according to claim 1, wherein the distal member includes an extending portion disposed on one surface of an end of the distal member at which the bend portion is provided, which one surface is opposite to another surface of the end of the distal member that faces the roller, the extending portion extending in a direction which intersects the distal portion and which is directed from the bend portion toward the presser-plate pivot shaft, wherein the angle adjuster includes a push-up member supported by the container so as to be pivotable about a push-up member pivot shaft parallel to the rotation shaft while a downstream end of the push-up member in the conveyance direction is located downstream of the push-up member pivot shaft, the push-up member being configured to pivot the basal member about the presser-plate pivot shaft by pivoting about the push-up member pivot shaft while the downstream end of the push-up member is held in contact with one surface of the basal member opposite to another surface thereof facing the roller, wherein the angle adjuster is configured such that, in a time period from the maximally loaded state till before reaching the first-amount loaded state, the bend angle is gradually decreased by pivoting the push-up member such that the downstream end of the push-up member is moved in a direction directed from the bend portion toward the presser-plate pivot shaft while the downstream end is kept interposed between the extending portion and the basal member, and wherein the angle adjuster is configured such that, when the first-amount loaded state is established, the push-up member is moved away from between the extending portion and the basal member, and the bend angle is kept defined by contact of the extending portion and the basal member.

7. The sheet conveying apparatus according to claim 1, wherein the distal member includes an extending portion disposed on one surface of an end of the distal member at which the bend portion is provided, which one surface is opposite to another surface of the end of the distal member that faces the roller, the extending portion extending in a direction which intersects the distal portion and which is directed from the bend portion toward the presser-plate pivot shaft, wherein the angle adjuster includes a push-up member supported by the container so as to be pivotable about a push-up member pivot shaft parallel to the rotation shaft while a downstream end of the push-up member in the conveyance direction is located downstream of the push-up member pivot shaft, the push-up member being configured to pivot the basal member about the presser-plate pivot shaft by pivoting about the push-up member pivot shaft while the downstream end of the push-up member is held in contact with one surface of the basal member opposite to another surface thereof that faces the roller, wherein the angle adjuster is configured such that, within the time period in which the state of the container changes from the maximally loaded state to the first-amount loaded state, the bend angle is gradually decreased at least in a time period from a first time point at which the state of the container is the maximally loaded state to a third time point at which a second amount of the plurality of sheets larger than the first amount are loaded on the container and which is earlier than a second time point at which the state of the container reaches the first-amount loaded state, by pivoting the push-up member such that the downstream end of the push-up member is moved in the direction directed from the bend portion toward the presser-plate pivot shaft while the downstream end is kept interposed between the extending portion and the basal member, and the push-up member is moved away from between the extending portion and the basal member at the third time point, and the bend angle is kept defined by contact of the extending portion and the basal member.

8. The sheet conveying apparatus according to claim 7, wherein the angle adjuster is configured such that the downstream end of the push-up member is held in contact with the extending portion and the basal member with the downstream end interposed between the extending portion and the basal member, in a time period from the first time point to the third time point.

9. The sheet conveying apparatus according to claim 7, wherein the angle adjuster is configured such that the downstream end of the push-up member is spaced apart from the extending portion while being held in contact with the basal member, in a time period from the third time point to the second time point.

10. The sheet conveying apparatus according to claim 7, wherein the angle adjuster is configured such that, in a time period from the first time point to the third time point, the downstream end of the push-up member is located at a height level higher than a distal end of the extending portion and is located at a height level lower than an end of the basal member nearer to the bend portion.

11. The sheet conveying apparatus according to claim 1, wherein the angle adjuster includes:

a push-up member supported by the container so as to be pivotable about a push-up member pivot shaft parallel to the rotation shaft while a downstream end of the push-up member in the conveyance direction is located downstream of the push-up member pivot shaft, the push-up member being configured to push up the distal member by pivoting about the push-up member pivot shaft while the downstream end of the push-up member is held in contact with one surface of the distal member opposite to another surface thereof facing the roller; and a transmission member configured to perform at least one of: transmission of a pivotal movement of the push-up member about the push-up member pivot shaft to a pivotal movement of the basal member about the presser-plate pivot shaft; and transmission of the pivotal movement of the basal member about the presser-plate pivot shaft to the pivotal movement of the push-up member about the push-up member pivot shaft.

12. The sheet conveying apparatus according to claim 1, wherein the angle adjuster includes a biasing member provided at the bend portion and biasing the presser plate in a direction to increase the bend angle, wherein the angle adjuster includes:

a push-up member supported by the container so as to be pivotable about a push-up member pivot shaft parallel to the rotation shaft while a downstream end of the push-up member in the conveyance direction is located downstream of the push-up member pivot shaft, the push-up member being configured to pivot the basal member about the presser-plate pivot shaft by pivoting about the push-up member pivot shaft while the downstream end of the push-up member is held in contact with one surface of the basal member opposite to another surface thereof facing the roller; and a limiter configured to come into contact with the downstream end of the presser plate in a process in which a state of the container changes from the maximally loaded state to the first-amount loaded state, so as to limit a movement of the downstream end, and wherein the angle adjuster is configured to decrease the bend angle against a biasing force of the biasing member such that the push-up member pushes up the basal member with the downstream end of the presser plate kept in contact with the limiter.

13. The sheet conveying apparatus according to claim 1, wherein the angle adjuster comprises a push-up member configured to push one of the distal member and the basal member up, and the angle adjuster is configured to adjust the bend angle such that a posture of the distal member is kept horizontal when the one of the distal member and the basal member is pushed up by the push-up member.

* * * * *